United States Patent [19]

Hwang

[11] Patent Number: 4,811,565

[45] Date of Patent: Mar. 14, 1989

[54] STEAM TURBINE VALVE MANAGEMENT SYSTEM

[75] Inventor: Edward Y. Hwang, Winter Park, Fla.

[73] Assignee: Westinghouse Electric Corp., Pittsburgh, Pa.

[21] Appl. No.: 153,301

[22] Filed: Feb. 5, 1988

[51] Int. Cl.[4] ..... F01K 13/02

[52] U.S. Cl. ..... 60/646; 60/657; 60/660

[58] Field of Search ..... 60/646, 657, 660

[56] References Cited

U.S. PATENT DOCUMENTS 3,097,488 7/1963 Eggenberger et al. ..... 60/660

3,097,489 7/1963 Eggenberger et al. ..... 60/660 X 4,320,625 3/1982 Westphal et al. ..... 60/646

*Primary Examiner*—Allan M. Ostrager

[57] ABSTRACT

A steam turbine inlet valve control system includes separately tunable valve characteristics for single valve and sequential valve operation modes. The sequential valve characteristics include both normal and alternate sequences which can be selected during operation of the steam turbine. The characteristics may be displayed to an operator and modified by graphical manipulation to simplify tuning the control system's characteristics to the steam turbine's operation. The control system also performs direct tracking of flow through the valves by converting sensed position signals to individual valve flow signals using a lift-to-flow conversion characteristic. Individual valve flow signals are summed and corrected for choked flow conditions to produce a tracked flow demand signal.

16 Claims, 6 Drawing Sheets

STEAM TURBINE VALVE MANAGEMENT SYSTEM

BACKGROUND OF THE INVENTION

1. Field of the Invention

The present invention is related to the control of steam turbines and, more particularly, to a method and system for controlling the inlet valves in different operating modes.

2. Description of the Related Art

The majority of electricity generated in the U.S. is generated by steam turbines that receive steam from a boiler heated by fossil fuel or a nuclear reactor. The amount of electricity produced by the turbine is controlled by inlet valves which determine how much of the steam is supplied to the steam turbine. Typically, there are six tg eight inlet valves which are operated in one of two modes. In a single valve or unison mode, all of the valves are opened at the same rate. This mode is used most often in starting the turbine so that the rotor is evenly heated by the entering steam.

A partially opened valve introduces throttling loss of energy from the steam and if all of the valves are partially opened, there is considerably more loss than if only one or two of the valves are partially open. As a result, a sequential mode of operation is used during the majoritY of the time that the turbine is operated. In the sequential operation mode, first a group of three or four valves are opened at the same rate until they are fully opened, or nearly so. Then, if additional steam flow is demanded, another one or two valves are opened to control the operation of the turbine, nnd when they are nearly fully opened then another one or two valves are opened, etc. until the turbine is controlled by the last one or two valves or is operating at maximum capacity.

The lift versus flow characteristics of inlet valves are non-linear. In recognition of this fact, conventional control systems store the lift versus flow characteristic of the valves for converting flow demand to valve lift or position. However, only a single flow-to-lift characteristic is stored and adjustments to the characteristic are equally applicable to both unison and sequential operation modes. Systems using such conventional systems are disclosed in U.S. Pat. Nos. 4,270,055; 4,368,520; 4,418,285; 4,512,185; and 4,554,788, among others, all issued to the assignee of the present invention and incorporated herein by reference.

SUMMARY OF THE INVETION

An object of the present invention is to provide an inlet valve control system having separate adjustments for unison and sequential operation modes.

Another object of the present invention is to provide alternate sequences in the sequential mode of operation which can be changed during operation of the steam turbine.

A further object of the present invention is to provide tracking of flow demand by converting the position signals controlling the inlet valves of the steam turbine into flow demand which would generate that position.

The above objects are obtained by providing a method for controlling, in response to a total demand signal, a plurality of inlet valves determining energy supplied to a power conversion device, the method comprising the steps of providing separate sets of adjustment characteristics for unison and sequential operation modes, selecting a valve operation mode from among the unison and sequential operation modes and positioning each of the inlet valves in dependence upon the sets of adjustment characteristics provided, the vlve operation mode selected and the total demand signal. This method is implemented by providing a control system for inlet valves comprising storage means for storing separate sets of adjustment characteristics for unison and sequential operation modes, selection means for selecting a valve operation mode from among the unison and sequential operation modes and positioning means for positioning each of the inlet valves in dependence upon the sets of adjustment characteristics, the valve operation mode and the total demand signal. Preferably, the selection means includes means for selecting, during operation of the power conversion device, between a normal sequence and an alternate sequence used in the sequential operation mode. Also, the system preferably includes tracking means for tracking steam flow passing through the inlet valves by summing the position signals to produce a sum and using a choking factor to convert the sum to a tracked flow demand.

DESCRIPTION OF THE PREFERRED EMBODIMENTS

Figure 1:
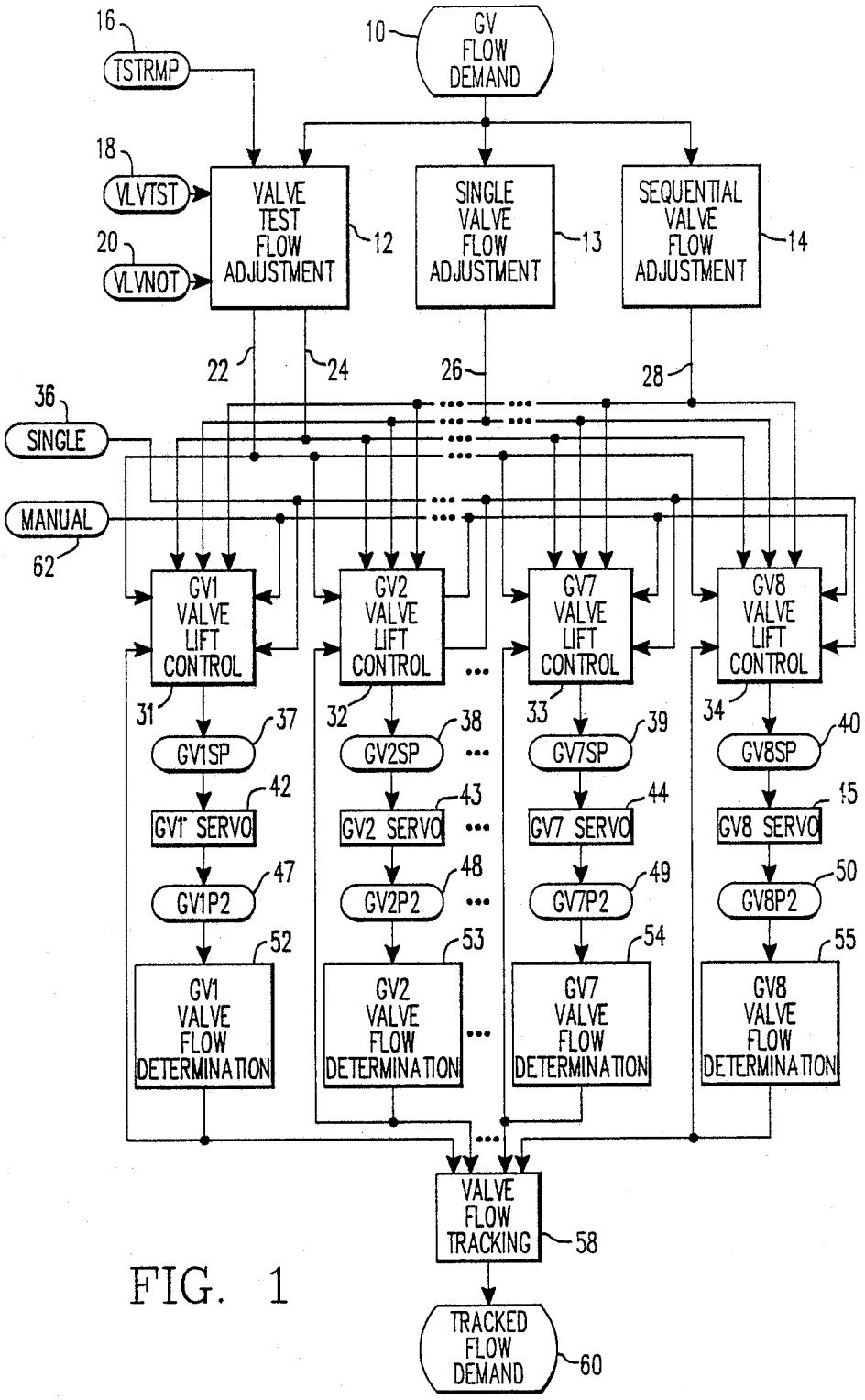
FIG. 1 is an overall block diagram of an inlet valve control system according to the present invention.

A block diagram of a valve control system for a steam turbine is illustrated in FIG. 1. Conventionally, steam turbines used for electrical power generation have inlet valves typically including two or four throttle valves and several governor valves. The block diagram in FIG. 1 illustrates control of eight governor valves GV1–GV8. A governor valve flow demand signal 10 is supplied to thee flow setpoint adjustment units 12–14. The valve test flow adjustment unit 12 also receives a testing ramp signal 16, a signal 18 indicating the number of valves under test and a signal 20 indicating the number of valves not being tested. The outputs from the valve test flow adjustment unit 12 are testing flow setpoint signals 22 supplied to the valves being tested and testing compensation flow demand signals 24, supplied to the valves which are not being tested. Valve test flow adjustment unit 12 maintains the requested total flow demand indicated by unit 10 by providing appropriate compensation for the one or more valves being tested. Typically, testing involves fully closing each of the valves periodically, e.g., once per month.

The single valve flow adjustment unit 13 and sequential valve flow adjustment unit 14 output single flow setpoint signal 26 and sequential flow setpoint signal 28, respectively. Which of these flow demand signals 26 and 28 are used by the valve lift control units 31–34 is determined by a single valve control mode signal 36.

The valve lift control units 31–34 provide position control signals 37–40 to servo units 42–45 of corresponding governor valves. Only the valve lift control units, setpoint signals, servo units, etc. for governor valves 1, 2, 7 and 8 are illustrated in FIG. 1, but as indicated by the dots, similar units are provided for governor valves 3-6. Also, the present invention is not limited to steam turbines having eight governor valves.

The servo units 42–45 provide sense position signals 47–50 indicating the position of the corresponding governor (inlet) valve. The sensed position signals 47–50 are supplied to valve flow determination units 52–55. The valve flow determination units 52–55 convert the sensed position signals to individual valve flow signals which are supplied to the valve lift control units 31–35 and a valve flow tracking unit 58. The valve flow tracking unit 58 outputs a tracked flow demand signal 60 which can be compared with the input flow demand signal 10 to confirm that the valves are operating properly. The individual valve flow signals are used in a manual control mode when a manual operation mode signal 62 is supplied.

Figure 2:
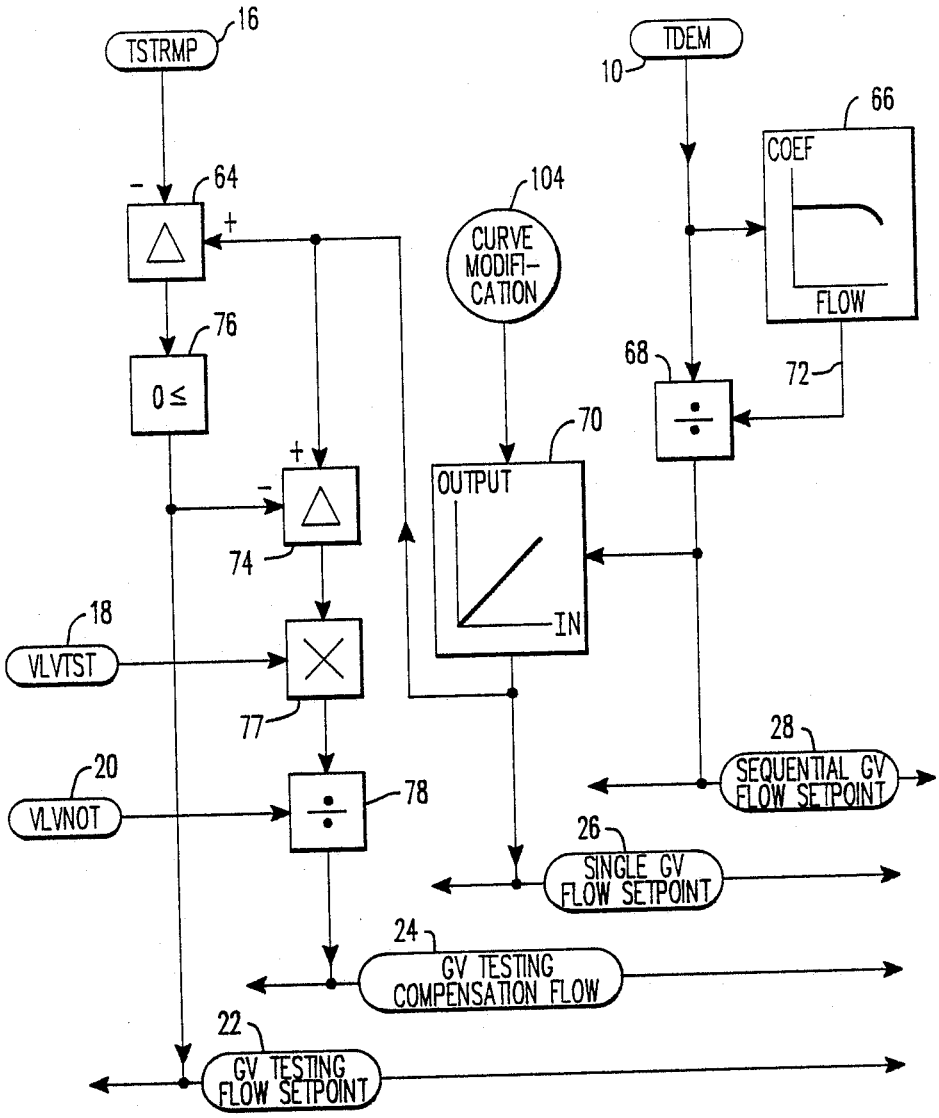
FIG. 2 is a more detailed block diagram of the valve mode and test flow adjustment units.

A more detailed block diagram of the valve mode and test flow adjustement units 12–14 is illustrated in FIG. 2. The testing ramp signal 16 is supplied to a subtractor 64, while the demand signal 10 is supplied to a flow-coefficient characteristic 66 and a divider 68. A divider signal output by the divider 68 is used to look-up the appropriate adjusted single flow demand signal 26 in a unison valve characteristic 70. A coefficient 72, used bY the divider 68 to divide the valve flow demand signal 10, is selected by using the valve flow demand signal 10 to access the flow coefficient characteristic 66. The single flow setpoint signal 26 is output by the single valve characteristic 70 and supplied to the subtractor 64 and a subtractor 74.

The testing ramp signal 16 is subtracted from the single flow setpoint signal 26 in the subtractor 64 and the result is checked by a non-negative output unit 76 to ensure that the testing flow setpoint signal 22 is non-negative. The testing flow setpoint signal 22 is subtracted from the single flow setpoint signal 26 by subtractor 74 and its output is multiplied in multiplier 77 by the number of valves under test 18 and divided in divider 78 by the number of valves not under test 20 to generate the testing compensation flow signal 24.

Figure 3:
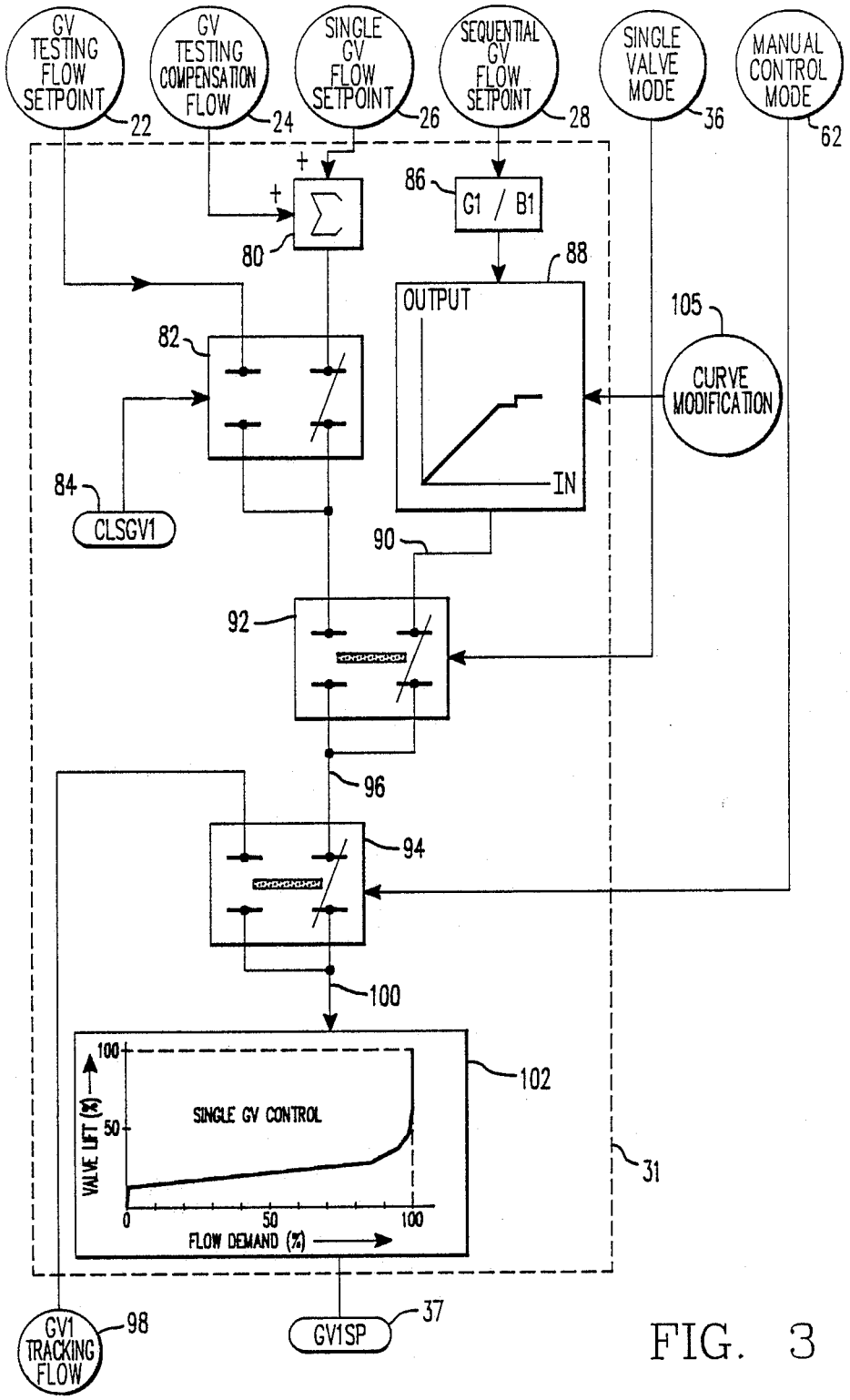
FIG. 3 is a more detailed block diagram of one of the valve lift control units in FIG. 1 llustrating valve position setpoint logic.

Each of the valve lift control units 31–34 illustrated in FIG. 1 is constructed in a similar manner. Therefore, only the valve lift control unit 31 for inlet or governor valve GV1 is illustrated in FIG. 3. The single flow setpoint signal 26 and testing compensation flow signal 24 are added by adder 80 and either the sum output by adder 80 or the testing flow setpoint signal 22 is selected by selection means 82 under the control of a testing logical state signal 84. As illustrated, testing is only possible during the unison or single valve operation mode in the embodiment illustrated in FIG. 3 because the calculation of compensation flow is much simpler. However, if it is desired to test valves in the sequential operation mode, the necessary changes can be made to the construction illustrated in FIG. 3, provided the more complex calculation of compensation flow is performed.

The sequential flow setpoint signal 28 is multiplied by gain G1 and reduced by biase B1 in gain/bias computation unit 86 prior to being converted using a sequential valve characteristic 88 to produce a sequential adjusted flow signal 90. Rate-limited selection means 92 switches between the sequential adjusted flow setpoint signal 90 and the output of the selection means 82. If governor valve GV1 is being tested, the testing flow setpoint signal 22 will be output by the selection means 82. If some other valve is being tested, the combination of the unison or single flow setpoint signal 26 and testing compensation flow signal 24 will be output by the selection means 82. It will be assumed below that none of the valves are being tested and that therefore the single flow setpoint signal 26 will be output by the selection means 82.

Manual/automatic rate-limited selection means 94 selects between the adjusted flow signal 96 output by the selection means 92 and an individual valve tracking flow signal 98 which supplies a signal indicating individual valve flow as described below. The selection means 92 and 94 are respectively controlled by the operation mode signal 36 and the manual/automatic control signal 62. Selection means 92 is preferably rate-limited by controlling the changes between the unison and sequential operation modes by gradually switching from one to the other in, e.g., 100 steps, by outputting an adjusted flow signal 96 which changes by 1/100 of the difference between the single adjusted flow setpoint signal 26 and the sequential adjusted flow setpoint signal 90 every, e.g., second, to produce the adjusted flow signal 96. Similarly, the manual/automatic selection means 94 is preferably constructed to gradually switch from control by the individual valve flow signal 98 to the adjusted flow signal 96 in, e.g., steps of 1/100 of the difference between signals 96 and 98 per second, to produce a flow control signal 100.

The flow control signal 100 is converted by a flow-to-lift conversion characteristic 102 to produce the GV1 valve position setpoint signal 37. As illustrated in FIG. 3, the flow-to-lift characteristic 102 of the valves are non-linear with a typical relationship illustrated. While frequently constructed valves have different flow-to-lift characteristics, governor valves on a steam turbine are usually constructed in a sufficiently similar manner that is sufficient to store a single flow-to-lift conversion characteristic 102 for use in all of the valve lift control units 31–34. This limitation is minimized by storing separate unison valve characteristics 70 in each of the valve lift control units 31–34 as well as separate sequential valve characteristics 88. To permit modification of these flow adjustment characteristics 70, 88, means 104 and 105 are provided for modification of the characteristic by graphical manipulation of the curves representing the characteristic.

A computing apparatus (not shown) used to perform a method according to the present invention preferably includes storage for the flow adjustment and flow-to-lift characteristics 70, 88, 102, a display for displaying curves like those illustrated for characteristics 70, 74, 88, 102 in FIGS. 2 and 3 and an input means for modifying displayed curves and indicating that modified curves should be stored. This permits a user to modify the operation of the inlet valves without performing calculations of how the valves' operation should be changed. The curve modification signals 104 and 105 are produced by the input means (not shown).

Figure 4:
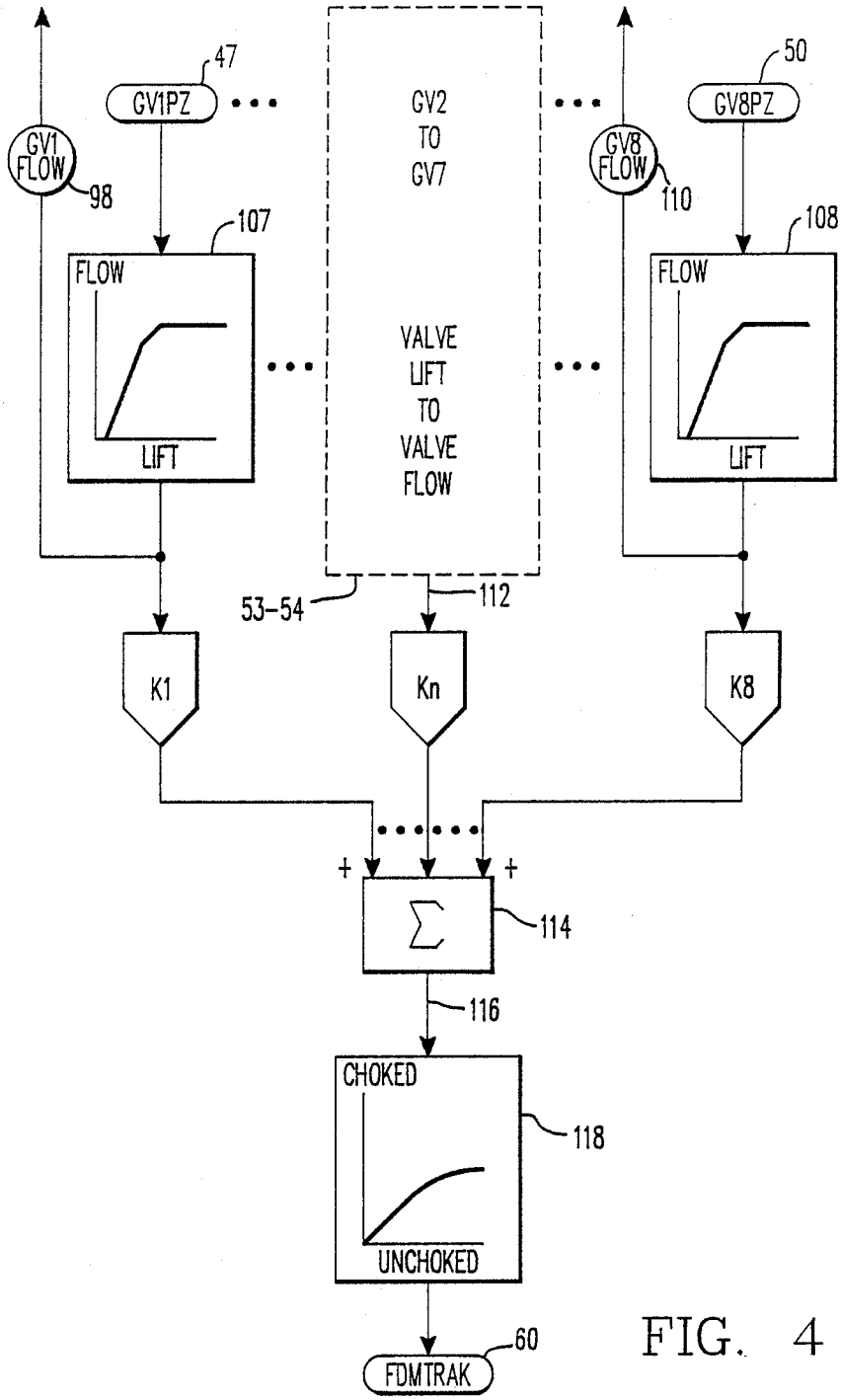
FIG. 4 is a more detailed block diagram of the lift-to-flow blocks and the valve flow tracking units in FIG. 1.

As described above, the position control signals 37–40 are each supplied to a corresponding servo unit among servo units 42–45 which position the valves in dependence upon the position control signals 37–40. Each of these servo units 42–45 includes a sensor for sensing the actual in the servo units 42–45 produce the sensed position signals 47–50 illustrated in FIG. 1. Two of these signals 47, 50 are also illustrated in FIG. 4 which is a more detailed block diagram of the valve flow determination units 52–55. The valve flow determination units 52 and 55 illustrated in FIG. 4 include lift-to-flow conversion characteristics 107, 108 which convert the sensed position signals 47, 50 into the individual valve flow signals 98 and 110. Similar conversion to individual valve flow signals is performed by lift-to-flow characteristics for the other inlet valves. The individual valve flow signals 98, 110, 112, etc. are summed by an adder 114 to produce a sum 116 which represents unchoked flow. The choking factor is determined and unchoked/choked flow characteristic 118 modifies the signal 116 to produce the tracked flow demand signal 60. As noted above, the tracked flow demand signal 60 can be compared with the requested flow demand signal 10. In addition, the tracked flow demand represented by the tracked flow demand signal 60 can be displayed to the operator to provide confirmation that the inlet valves are operating properly.

Figure 5:
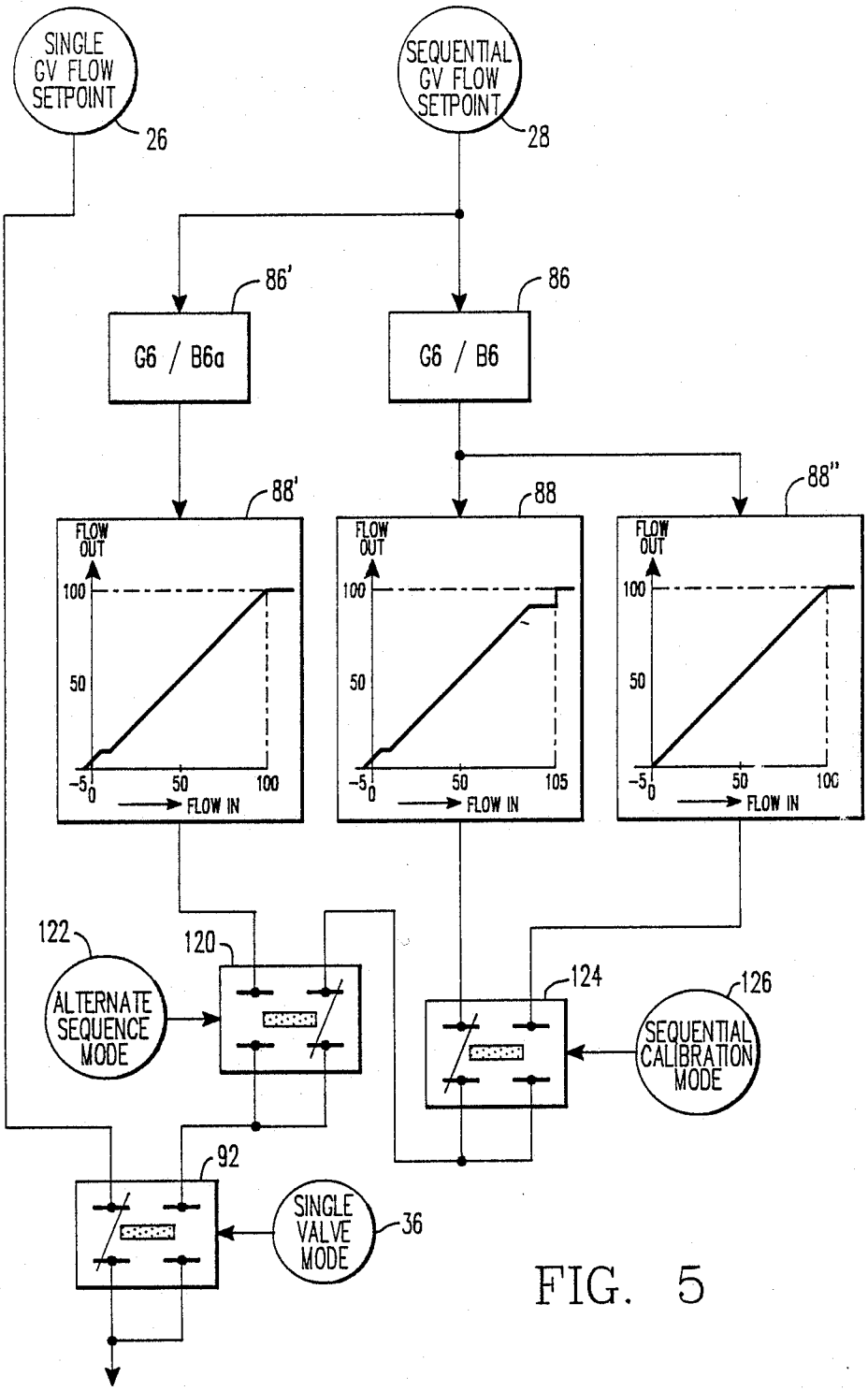
FIG. 5 is a detailed block diagram of a second embodiment of the sequential mode adjustments.

For simplicity, FIG. 3 illustrates only a single sequential valve characteristic 88. According to a second embodiment of the present invention, there at least two sequences which can be used in the sequential operation mode. Elements which differ in the second embodiment are illustrated in FIG. 5. The sequential valve characteristic 88 for a normal sequence is identified by reference numeral 88. An alternate sequence sequential valve characteristic 88' and a sequential calibration characteristic 88" are also provided in the second embodiment. Because of the differences in sequences, alternate gain and bias is used in the gain/bias computation unit 86'.

Figure 6A:
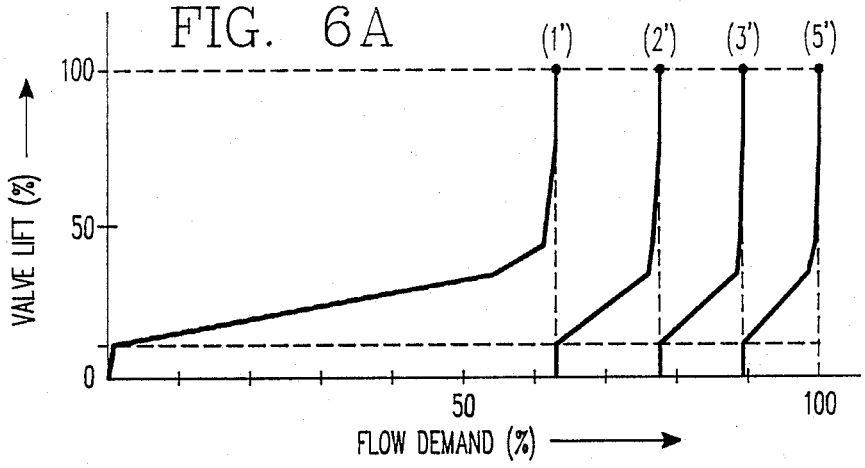
FIGS. 6A-6C are graphical representations of normal and alternate sequences for controlling the valves in the sequential mode.
Figure 6B:
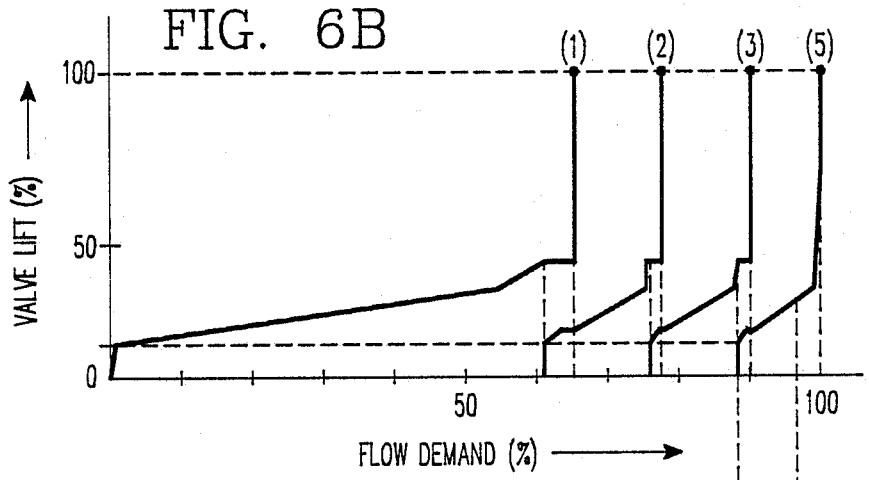
Figure 6C:
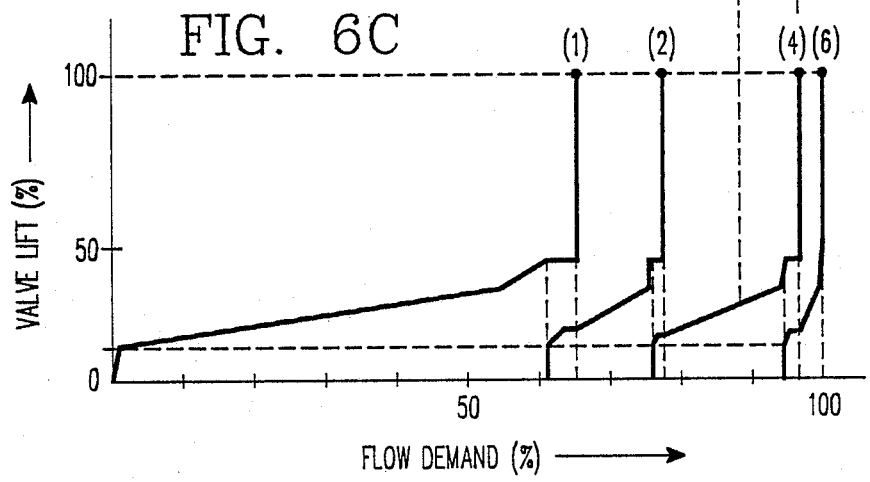

The differences between the various sequential valve characteristics 88, 88' and 88" are illustrated in FIGS. 6A–6C. The calibration characteristic 88" is used to control the valves as illustrated in FIG. 6A. As the flow demand signal 10 increases, first the valves in Group 1 are opened, then the valves in Groups 2, 3 and 5. Each group is fully opened before the next group so that there is no overlap during delibration. Typically, there will be four valves in the first group, one each in groups 2, 3 and two valves in group 5. In the normal sequence, the groups are activated in the same order, but there is a slight overlap and the opening of the valves is modified as indicated in the graph corresponding to reference numeral 88 to begin opening before required and stop short before being fully opened until after the flow demand 10 has increased beyond the point where the next group of valves would normally begin to open. This overlap is illustrated by the curves FIG. 6B.

In the alternate sequence, the order of the valve is modified. For example, the first and second groups may remain the same, the next group indicated by a (4) may include two valves and the last group (6) may include only a single valve. The alternate sequence is used when the turbine is operated at near full capacity so that there is only a single valve controlling the operation of the turbine, thereby reducing throttling loss.

A control system according to the present invention is able to switch between the normal and alternate sequences during operation of the steam turbine. Selection means 120 responds to an alternate sequence mode signal 122 to perform this function. The selection means 124 responds to a sequential calibration mode signal 126 to select between the normal and calibration sequential valve characteristics 88 and 88". The selection means 120 and 124 are rate-limited switches.

Although the invention is illustrated as being composed of discrete elements, the invention may be practiced by properly programming a microprocessor, such as an Intel 8086, to perform the described functions in cooperation with memory and input/output units.

The many features and advantages of the present invention are apparent from the detailed specification and thus, it is intended by the appended claims to cover all such features and advantages of the device which fall within the true spirit and scope of the invention. Further, since numerous modifications and changes will readily occur to those skilled in the art, it is not desired to limit the invention to the exact construction and operation illustrated and described. Accordingly, all suitable modifications and equivalents may be resorted to falling within the scope and spirit of the invention.

What is claimed is:

1. A method for controlling, in response to a total demand signal, a plurality of inlet valves controlling energy supplied to a power conversion device, said method comprising the steps of:

(a) providing separate sets of adjustment characteristics corresponding to unison and sequential operation modes;

(b) selecting a valve operation mode from among the unison and sequential operation modes and (c) positioning each of the inlet valves in dependence upon the sets of adjustment characteristics provided in step (a), the valve operation mode selected in step (b) and the total demand signal.

2. A method as recited in claim 1, wherein the sequential operation mode includes normal and alternate sequences, and wherein said selecting in step (b) includes selecting between the normal and alternate sequences in the sequential operation mode during operation of the power conversion device.

3. A method as recited in claim 1, further comprising the step of (d) tracking flow demand by converting said positioning of the inlet valves in step (c) into an indication of flow through the valves.

4. A method as recited in claim 3, wherein step (c) comprises the steps of:

(ci) determining desired positions of the inlet valves in dependence upon the adjustment characteristics provided in step (a), the valve operation mode selected in step (b) and the total demand signal;

(cii) generating position control signals for positioning the inlet valves at the desired positions in dependence upon said determining in step (ci); and (ciii) adjusting the position of the inlet valves in dependence upon the position control signals, and wherein step (d) comprises the steps of:

(di) detecting the position of each of the inlet valves to produce sensed position signals;

(dii) converting each of the sensed position signals to individual valve flow signals in dependence upon a corresponding lift-to-flow characteristic; and (diii) calculating the indication of flow through the valves by summing the individual valve flow signals and multiplying by a choking factor.

5. A method as recited in claim 4, further comprising the step of (e) converting the individual valve flow signals produced by step (dii) into the position control signals in a manual mode of operation where an operator adjusts the sensed position signals.

6. A method as recited in claim 1, further comprising the step of (d) switching between the unison and sequential operation modes during operation of the power conversion device by gradually changing the positions of the inlet valves.

7. A control system for inlet valves supplying energy to a power conversion device in response to a total demand signal, said system comprising:

storage means for storing separate sets of adjustment characteristics corresponding to unison and sequential operation modes;

selection means for selecting a valve operation mode from among the unison and sequential operation modes; and positioning means for positioning each of the inlet valves in dependence upon the adjustment characteristics stored in said storage means, the valve operation mode selected by said selection means and the total demand signal.

8. A system as recited in claim 7, wherein the energy is supplied in the form of steam to a steam turbine functioning as the power conversion device, and wherein said system further comprises modification means for independently modifying the adjustment characteristics corresponding to the unison and sequential operation modes.

9. A system as recited in claim 8, wherein said positioning means generates sensed position signals indicating the positions of the inlet valves, and wherein said system further comprises tracking means for tracking steam flow passing through the inlet valves by converting the sensed position signals to individual valve flow signals, summing the individual valve flow signals to produce a sum and multiplying the sum by a choking factor to produce a tracked flow demand signal.

10. A system as recited in claim 7, wherein said selection means comprises means for selecting, during operation of the power conversion device, between a normal sequence and an alternate sequence in the sequential operation mode.

11. A system as recited in claim 10, wherein said storage means stores different conversion characteristics corresponding to each of the unison operation mode and the normal sequence and the alternate sequence in the sequential operation mode.

12. A system as recited in claim 7, wherein said selection means comprises means for gradually switching between the unison and sequential operation modes by controlling said positioning means to gradually change the positions of the inlet valves.

13. A control system for inlet valves supplying steam to a steam turbine in response to a total demand signal, said system comprising:

storage means for storing a unison valve characteristic corresponding to a unison operation mode and sequential valve characteristics corresponding to a sequential operation mode, the unison and sequential valve characteristics adjusting flow demand for the inlet valves, and for storing a separate flow-to-lift conversion characteristic relating adjusted flow to position of the inlet valves;

mode selection means for selecting a valve operation mode from among the unison and sequential operation modes;

adjustment means for producing adjusted flow signals corresponding to one or more of the inlet valves in dependence upon the total demand signal and a valve characteristic corresponding to the valve operation mode selected by said mode selection means;

position determination means for generating position control signals for the inlet valves in dependence upon flow control signals and the flow-tolift conversion characteristic and for generating sensed position signals indicating the position of the inlet valves;

tracking means for converting the sensed position signals to individual valve flow signals, summing the individual valve flow signals to produce a sum and multiplying the sum by a choking factor to produce a tracked flow demand signal;

control selection means for selecting between the adjusted flow signals and the individual valve flow signals to be supplied as the flow control signals to said position determination means for conversion into the position control signals; and valve positioning means for positioning the valves in dependence upon the position control signals.

14. A system as recited in claim 13, wherein said storage means stores normal and alternate sequences for the sequential operation mode, and wherein said mode selection means further comprises means for selecting between the normal and alternate sequences stored in said storage means.

15. A system as recited in claim 13, wherein said mode selection means further includes means for gradually switching between the unison and sequential operation modes by controlling said position determination means to gradually change the position control signals, and wherein said control selection means further includes means for gradually switching from control by the individual valve flow signals to the adjusted flow signals.

16. A system as recited in claim 13, further comprising modification means for independently modifying the unison and sequential valve characteristics and the flow-to-lift conversion characteristics, stored in said storage means, by graphical manipulation.

* * * * *